US006837060B2

(12) United States Patent
Collins

(10) Patent No.: US 6,837,060 B2
(45) Date of Patent: Jan. 4, 2005

(54) ADAPTIVE DEFROST CONTROL DEVICE AND METHOD

(75) Inventor: Martin Collins, Greenville, MI (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/730,610

(22) Filed: Dec. 8, 2003

(65) Prior Publication Data

US 2004/0112072 A1 Jun. 17, 2004

Related U.S. Application Data

(63) Continuation of application No. 10/357,065, filed on Feb. 3, 2003, now Pat. No. 6,694,755, which is a continuation of application No. 09/968,669, filed on Oct. 1, 2001, now Pat. No. 6,523,358.

(60) Provisional application No. 60/280,072, filed on Mar. 30, 2001.

(51) Int. Cl.[7] ..... F25D 21/06

(52) U.S. Cl. ..... 62/156; 62/80; 62/155; 62/234

(58) Field of Search ..... 62/156, 155, 151, 62/275, 234, 80

(56) References Cited

U.S. PATENT DOCUMENTS

| | | | | |
|---|---|---|---|---|
| 4,156,350 | A | | 5/1979 | Elliot et al. |
| 4,173,871 | A | | 11/1979 | Brooks |
| 4,197,717 | A | | 4/1980 | Schumacher |
| 4,251,988 | A | | 2/1981 | Allard et al. |
| 4,269,035 | A | | 5/1981 | Gelbard |
| 4,297,852 | A | | 11/1981 | Brooks |
| 4,299,095 | A | | 11/1981 | Cassarino |
| 4,327,556 | A | | 5/1982 | Zampini et al. |
| 4,327,557 | A | | 5/1982 | Clarke et al. |
| 4,373,349 | A | | 2/1983 | Mueller |
| 4,481,785 | A | | 11/1984 | Tershak et al. |
| 4,528,821 | A | | 7/1985 | Tershak et al. |
| 4,573,326 | A | | 3/1986 | Sulfstede et al. |
| 4,680,940 | A | | 7/1987 | Vaughn |
| 4,689,965 | A | | 9/1987 | Janke et al. |
| 4,694,657 | A | | 9/1987 | Vaughn |
| 4,750,332 | A | | 6/1988 | Jenski et al. |
| 4,850,204 | A | | 7/1989 | Bos et al. |
| 4,884,414 | A | | 12/1989 | Bos |
| 4,938,027 | A | | 7/1990 | Midlang |
| 5,228,300 | A | | 7/1993 | Shim |
| 5,231,844 | A | | 8/1993 | Park |
| 5,363,669 | A | | 11/1994 | Janke et al. |
| 5,440,893 | A | | 8/1995 | Davis et al. |
| 5,469,715 | A | | 11/1995 | Janke et al. |
| 5,493,867 | A | | 2/1996 | Szynal et al. |
| 5,515,689 | A | | 5/1996 | Atterbury |
| 5,564,286 | A | * | 10/1996 | Suse ..... 62/153 |
| 5,924,297 | A | * | 7/1999 | Wolff et al. ..... 62/152 |
| 6,138,464 | A | | 10/2000 | Derosier et al. |
| 6,606,870 | B2 | * | 8/2003 | Holmes et al. ..... 62/155 |
| 2003/0056526 | A1 | * | 3/2003 | Holmes et al. ..... 62/156 |

FOREIGN PATENT DOCUMENTS

| | | |
|---|---|---|
| JP | 54-47148 A | 4/1979 |

* cited by examiner

*Primary Examiner*—Marc Norman
(74) *Attorney, Agent, or Firm*—Pearne & Gordon LLP

(57) ABSTRACT

A method for defrosting a household refrigeration appliance including a compressor and a defrost heater. After a controller indicates that it is time for a defrost cycle, the compressor is operated if the temperature of the appliance is greater than a set temperature. The compressor is stopped when a temperature of the appliance is equal to or less than the set temperature. After the step of stopping, the temperature of the appliance is raised while the defrost heater is inactivated. After the temperature is raised, the defrost heater is energized. The controller pauses for a drip time after deenergizing the defrost heater before allowing the compressor to run.

5 Claims, 4 Drawing Sheets

ADAPTIVE DEFROST CONTROL DEVICE AND METHOD

CROSS-REFERENCE TO RELATED APPLICATIONS

This application is a continuation of U.S. patent application Ser. No. 10/357,065 filed on Feb. 3, 2003, now U.S. Pat. No. 6,694,755, which is a continuation of U.S. patent application Ser. No. 09/968,669 filed on Oct. 1, 2001, now U.S. Pat. No. 6,523,358, which claims the benefit of U.S. Provisional Application No. 60/280,072 filed on Mar. 30, 2001.

BACKGROUND OF THE INVENTION

The present invention relates generally to the control of a defrost heater for a refrigerator and specifically to an adaptive control method and apparatus therefor.

It is known to provide a defrost heater to a refrigeration unit such as in a domestic refrigerator or freezer appliance. In conventional arrangements, the heater is cycled on the basis of electromechanical timers which accumulate time on the basis of compressor run time. When the timer accumulates a predetermined amount of compressor run time, the defrost heater initiates a defrost cycle, regardless of the current state of various refrigeration components and environment. This can lead to an inefficient use of energy.

BRIEF SUMMARY OF THE INVENTION

The present invention provides a method for defrosting a household refrigeration appliance including a compressor and a refrigeration compartment having a door. Said method comprises the steps of: waiting for a defrost interval (X) based on accumulated compressor run time; initiating a defrost cycle only after both the defrost interval has elapsed and the compressor is not running; and after initiating said defrost cycle, terminating said defrost cycle as determined by a defrost termination thermostat.

The present invention further provides a defrosting refrigerator, comprising: a cooling apparatus for providing cooling air to the refrigerator when operating; a defrost apparatus which operates upon initiation for a defrost period; and a controller which initiates the defrost apparatus after a set defrost interval elapses and only when the cooling apparatus is not operating.

The present invention further provides a method for defrosting a household refrigeration appliance comprising the steps of: providing a control means for controlling a defrost means of the appliance; initiating a defrost cycle after a defrost interval has elapsed; adjusting the defrost interval of the control means to a vacation defrost interval, which is greater than a maximum normal defrost interval, if a door of the appliance has not been opened for a predetermined period; and resetting the defrost interval of the control means to equal or less than the maximum normal defrost interval from the vacation defrost interval when the door is opened.

The present invention further provides a defrosting refrigerator comprising: a defrost apparatus; at least one compartment having a door, the door having a sensor for detecting the open or closed condition of the door; and a controller which monitors the sensor, which initially controls the defrost apparatus according to a first mode, and which controls defrost apparatus according to a second mode when the sensor indicates the door has been closed for a predetermined period, wherein the controller reverts to the first mode if the sensor indicates the door is opened.

DETAILED DESCRIPTION OF THE INVENTION

Figure 1:
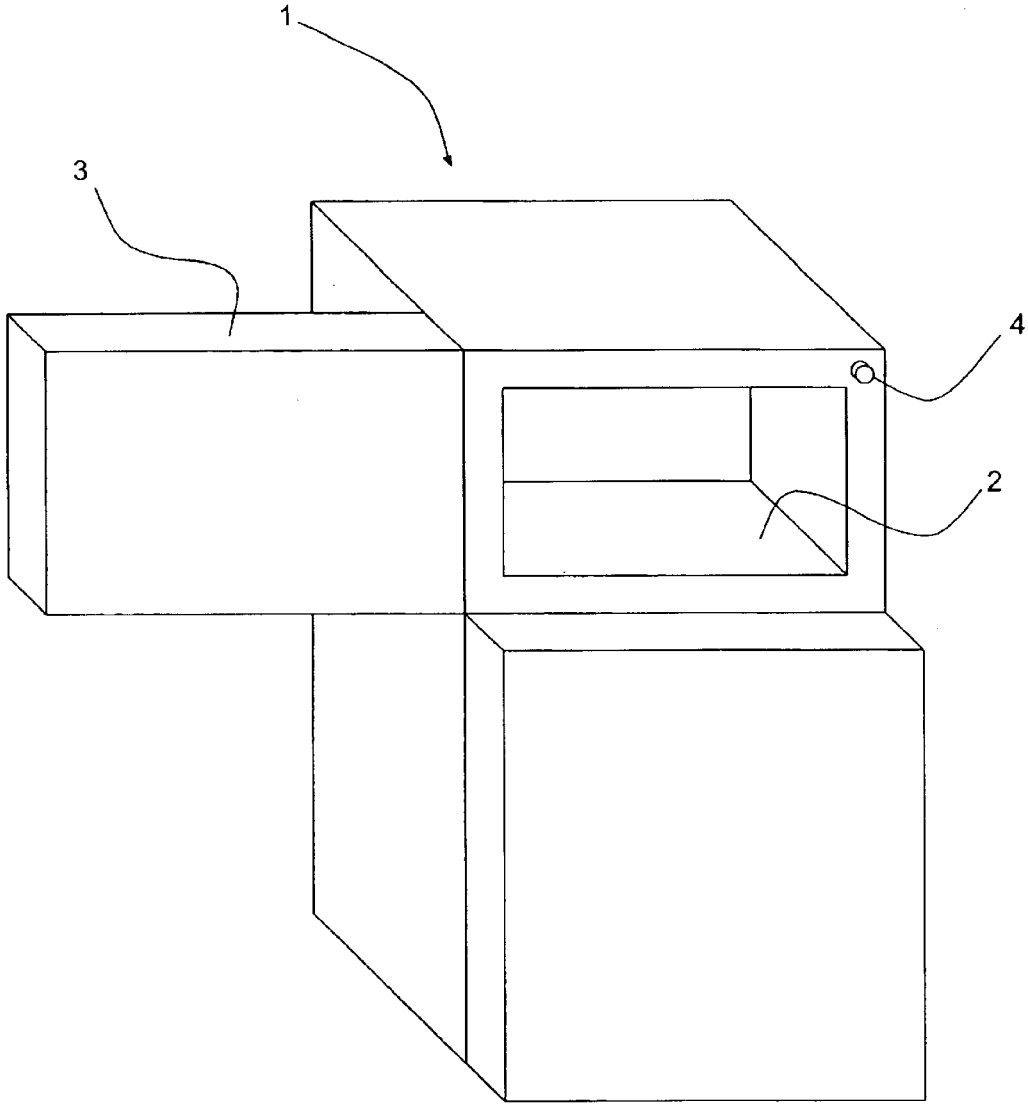
FIG. 1 is a perspective view of a refrigerator embodying an adaptive defrost control of the present invention.

FIG. 1 shows a refrigerator 1 having a freezer compartment 2. The freezer compartment 2 is provided with a door 3 having a switch 4 which monitors the condition of the door 3, either open or closed.

Figure 2:
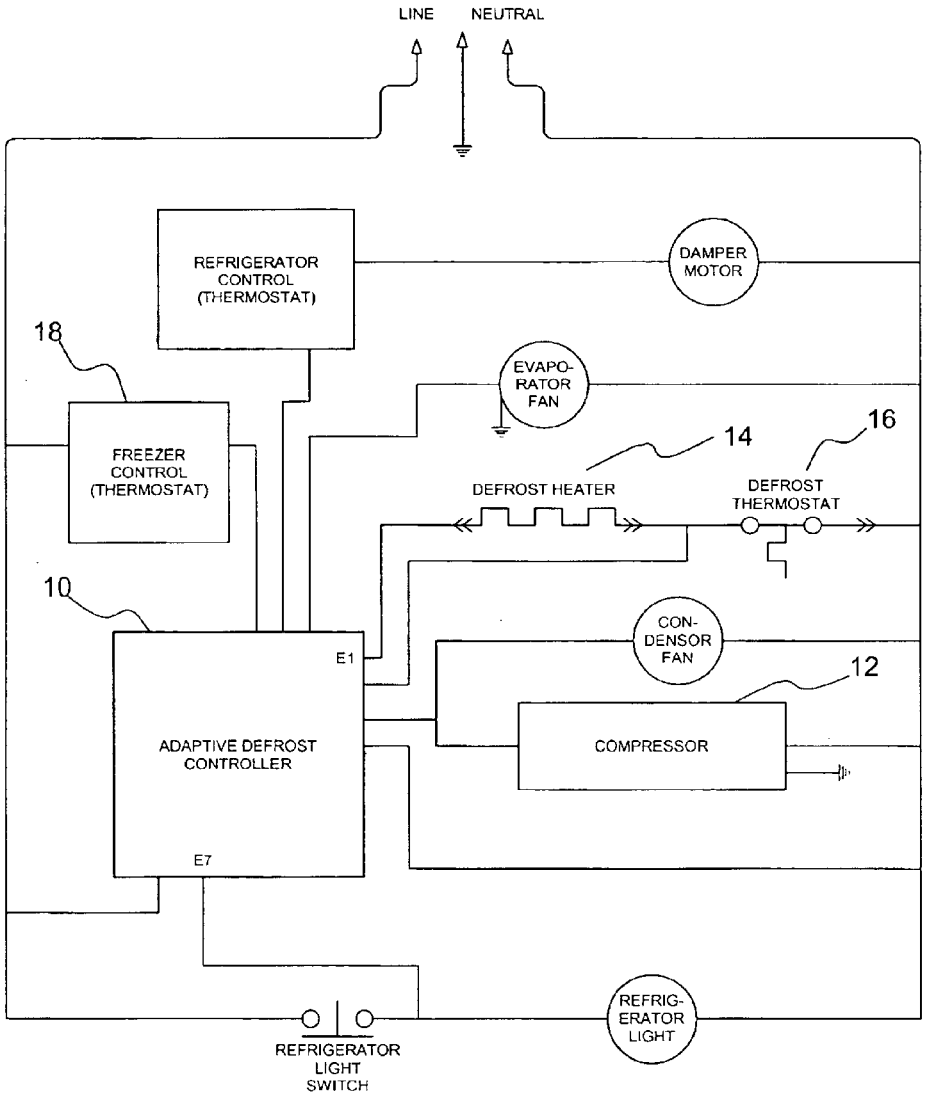
FIG. 2 is a schematic view of the electrical connections of a refrigerator embodying the adaptive control of the present invention.

FIG. 2 shows an wiring schematic for the refrigerator 1 which comprises an adaptive defrost controller 10, a compressor 12, and a defrost heater 14. The defrost heater 14 is provided to defrost the freezer compartment 2 of the refrigerator 1 (see FIG. 1). The controller 10 is programmed to control the defrost heater to carry out the present invention, as described below. In a sense, the controller 10 does the job of the electromechanical timer in the prior art, accumulating compressor run time until it has accumulated an amount of time equal to a set defrost interval, X. At this point the controller 10 indicates that it is time for a defrost cycle.

However, the controller 10 is also programmed to adjust the value of the defrost interval X, based upon certain operating conditions. In order to reduce the above described waste of energy, the adaptive defrost controller 10 monitors the defrost time and adjusts the defrost time interval accordingly.

Figure 3:
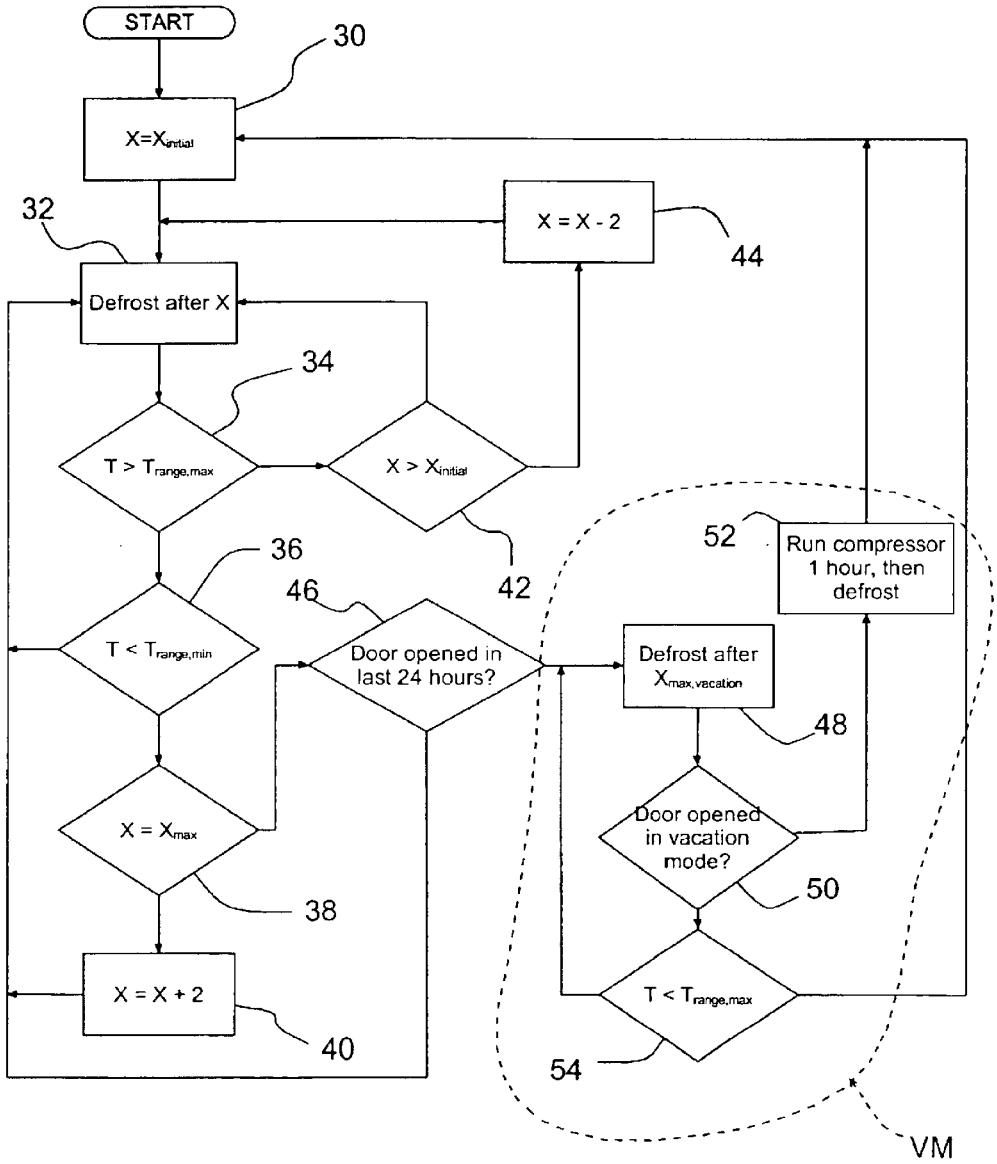
FIG. 3 is a flow diagram for a method of performing an adaptive defrost control according to an embodiment of the present invention.

The algorithm shown in FIG. 3 illustrates one embodiment for adjustment of the heater cycle time, X according to the present invention. First, the defrost interval X is set to be equal to a minimum or initial defrost interval, $X_{initial}$, such as 6 hours (step 30). After the controller 10 has accumulated X hours, a defrost cycle is initiated (step 32).

A defrost termination thermostat or controller 16 (FIG. 2) turns off the heater when sufficient defrosting has occurred. Meanwhile, the controller 10 stores the duration of the defrost cycle or defrost time, T. $T_{range}$ defines the time limits for an "ideal" defrost time. For example, $T_{range}$ could be a range of 12 to 16 minutes. If the defrost time, T, is greater than a maximum "ideal" defrost time, $T_{range,max}$, or 16 minutes, as determined in step 34, then the controller 10 proceeds to step 42. Otherwise, if the defrost time, T, is less than a minimum "ideal" defrost time, $T_{range,min}$, or 12 minutes as determined in step 36, then the controller 10 proceeds to step 38. Otherwise, if T is within the "ideal" defrost time, $T_{range}$, or between 12 and 16 minutes, then the controller 10 returns to step 32 and waits for the next defrost cycle.

If the controller reaches step 38, then the defrost cycle, T, is too short for maximum efficiency. At this point, if the defrost interval X is already set to a maximum value, $X_{max}$, such as 72 hours, then the controller 10 proceeds to step 46. Otherwise, the defrost interval X is incremented by a set increment, such as 2 hours, (step 40) and the controller 10 returns to step 32 and waits for the next defrost cycle. This lengthening of the defrost interval, X, will help to increase the length of the subsequent defrost cycle, T.

If the controller reaches step 42, then the defrost cycle, T, is too long for maximum efficiency. At this point, if the defrost interval, X, is already set to the minimum value, $X_{initial}$, then the controller 10 returns to step 32 and waits for the next defrost cycle. If, however, the defrost interval, X, is greater than $X_{initial}$ then the controller decrements the defrost interval, X, by the set increment, or 2 hours, (step 44) before returning to step 32.

If the controller reaches step 46, then the defrost cycle, T, is too short for maximum efficiency but the defrost time, T, is already at a maximum ideal defrost time, $T_{range,max}$, or 16 minutes. If the controller 10 determines by monitoring the door switch 4 at input E7 that the freezer door 3 has not been opened in the preceding 24 hours, vacation mode VM is entered at step 48. Otherwise, the controller 10 returns to step 32 and waits for the next defrost cycle.

Once in vacation mode VM at step 48, the controller waits for a vacation mode time, $X_{max,vacation}$, such as 160 hours, initiates a defrost cycle and then proceeds to step 50. At step 50, if the controller determines that the freezer door 3 has been opened while in vacation mode, the controller exits vacation mode VM via step 52. At step 52, the compressor 12 is run for a predetermined vacation mode exit period, such as one hour, and is followed by a defrost cycle. Following step 52, the controller 10 exits vacation mode VM and proceeds to step 30, resetting X to $X_{initial}$.

If the door is not opened at step 50, the controller proceeds to step 54. At step 54, while in vacation mode VM, if the defrost cycle time, T, is below $T_{range,max}$, then vacation mode VM is maintained and the controller 10 returns to step 48. If, however, T is equal or greater than $T_{range,max}$, then the controller exits vacation mode VM directly and proceeds to step 30, resetting X to $X_{initial}$.

In addition to the above, an absolute maximum amount of time that the defrost heater can be on, $T_{max}$, is set. During the defrost cycle, if the controller 10 determines that the heater has been on for $T_{max}$, the heater is immediately terminated at output El, any drip time (explained below) is skipped, and the controller returns to step 30, allowing the compressor to restart immediately at the demand of the compressor thermostat or cold control 18.

Figure 4:
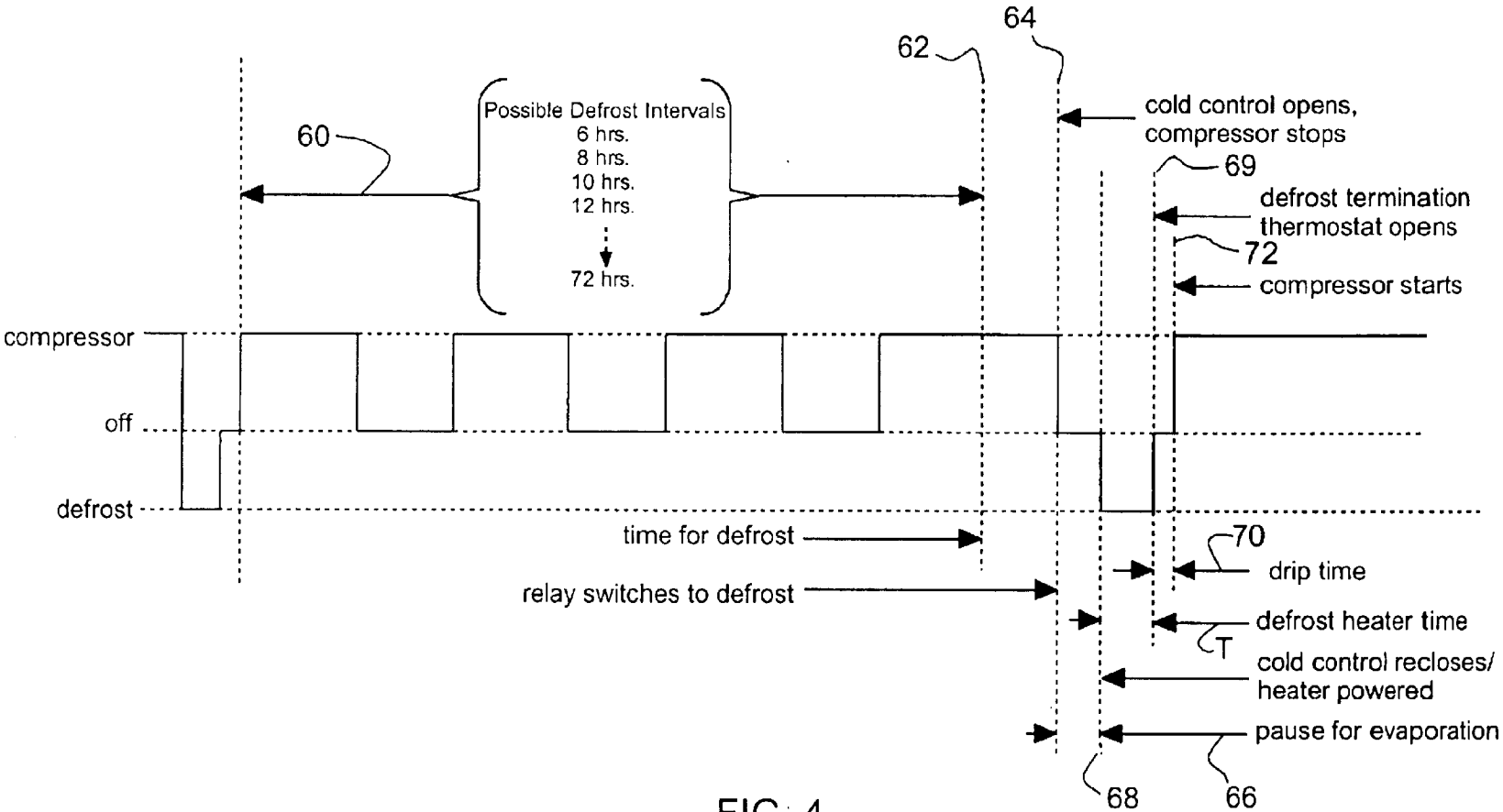
FIG. 4 is a timing chart illustrating various steps of a method of performing an adaptive defrost control according to an embodiment of the present invention.

FIG. 4 illustrates a defrost delay used in the present invention to avoid applying defrost heat to boil off liquid refrigerant which may be present in an evaporator.

Ordinarily, the compressor uses energy to condense the refrigerant in a condenser, which in turn absorbs heat from refrigeration compartments causing liquid refrigerant to evaporate and thereby cooling the compartments. However, if the defrost heater is energized while the condenser contains liquid refrigerant, such as immediately following a compressor run cycle, this liquid may be evaporated by the defrost heater, rather than by energy absorbed from the refrigeration compartments.

According to the present invention, in order to minimize liquid refrigerant being boiled off by the defrost heater 14, the adaptive defrost controller 10 will not turn on the defrost heater 12 while the compressor thermostat 18 is closed indicating that the compressor is running. That is, once the timing algorithm determines it is time for a defrost cycle to occur, the controller pauses and waits for the freezer compartment 2 to become sufficiently cold before starting the heater 14. During this delay, compressed liquid refrigerant in the condenser is re-evaporated by heat energy from the freezer compartment 2, such that the cooling is not allowed to be wasted by the defrost heater 14.

Specifically, as shown by FIG. 4, the defrost cycle is controlled by the controller as follows. The defrost interval, X, is allowed to elapse by accumulation of compressor run time during the cycling on and off of the compressor (step 60). At time 62, the controller 10 determines that it is time for a defrost cycle to occur.

The controller 10 waits for the compressor thermostat 18 to open, shutting the compressor 12 off at time 64. At the same time 64, a relay is switched to a defrost mode which, among other things, keeps the compressor 12 from turning back on. Subsequently, the controller pauses for a period of time 66 to allow evaporation of the refrigerant just compressed into liquid by the action of the compressor.

Once enough heat is absorbed by the refrigerant to re-close the compressor thermostat 18 at time 68, the defrost heater 14 is powered. The defrost heater 14 remains on for a period of time, or the defrost period, T, until at time 69, the defrost termination thermostat 16 turns off the heater 14.

Following the termination of the heater 14, the controller 10 waits for a predetermined "drip time" 70 and then resumes normal compressor operation 72.

In the present embodiment, the adaptive defrost controller 10 is an electronic controller. If power to the controller 10 is interrupted for more than a few seconds, a memory circuit contained therein resets to a condition as though it had not been powered previously. Therefore, the information or data necessary for the adaptive defrost controller to operate as desired is lost. For instance, a brief power failure may interrupt a defrost cycle after the defrost heater 14 has been initiated. When power is restored, the adaptive defrost controller 10 would reset, returning to step 30 (FIG. 3) and defrosting would not resume until the defrost interval, X, has again elapsed. This could result in poor cooling performance due to the unintended extended time interval between defrosts.

The defrost termination thermostat 16 of the present embodiment is of a type which operates regardless of power interruption, such as a mechanical thermostat. Therefore, the termination thermostat 16 can be used by the adaptive defrost controller as a power independent memory device. For this purpose, the controller 10 checks the condition of the termination thermostat 16 upon the initial application of power. If the termination thermostat 16 is open, the appliance is presumed to be operating from a warm or newly uncrated condition. In this case, the controller 10 starts the compressor 12 and begins normal adaptive defrost control.

If the termination thermostat 16 is closed upon the application of power to the adaptive defrost controller 10, the appliance is in a cold state and a temporary power outage condition is presumed. In this case, the compressor 12 is run for a shortened interval followed by a defrost cycle. Following this shortened defrost interval, normal adaptive defrost control is resumed.

It should be evident that this disclosure is by way of example and that various changes maybe made by adding, modifying or eliminating details without departing from the fair scope of the teaching contained in this disclosure. The invention is therefore not limited to particular details of this disclosure except to the extent that the following claims are necessarily so limited.

What is claimed is:

1. A method for defrosting an evaporator of a refrigeration sealed system, the system including a controller operatively coupled to an evaporator fan, a condenser fan and a defrost heater, said method comprising:

operating the sealed system until a selected time till defrost interval expires;

initiating a defrost cycle when the time till defrost interval expires; and selectively operating the sealed system to raise a temperature of the evaporator while the defrost heater is inactivated.

2. A method for defrosting a refrigeration appliance including a freezer compartment and a sealed system including a controller and a compressor, an evaporator, a condenser, an evaporator fan and a condenser fan operatively coupled thereto, the method utilizing a defrost heater, said method comprising:

operating the sealed system until a selected time till defrost interval expires;

initiating a defrost cycle when the time till defrost interval expires;

operating the sealed system to prechill the refrigeration compartment;

selectively operating the sealed system to raise a temperature of the evaporator; and energizing the defrost heater after selectively operating the sealed system to raise a temperature of the evaporator.

3. A method in accordance with claim 2 further comprising: defrosting the evaporator with the defrost heater; suspending operation of the sealed system for a predetermined dwell time; and activating the compressor and the condenser to lower a temperature of the evaporator.

4. A method for defrosting a household refrigeration appliance including a compressor and a defrost heater, said method comprising:

indicating by a controller that it is time for a defrost cycle;

after said step of indicating, operating the compressor if the temperature of the appliance is greater than a set temperature;

stopping the compressor when a temperature of the appliance is equal to or less than the set temperature;

after said step of stopping, raising the temperature of the appliance while the defrost heater is inactivated.

5. The method for defrosting according to claim 4, further comprising:

after said step of raising the temperature, energizing the defrost heater; and pausing for a drip time after deenergizing the defrost heater before allowing the compressor to run.

* * * * *